US008196425B2

(12) United States Patent
Popov

(10) Patent No.: US 8,196,425 B2
(45) Date of Patent: Jun. 12, 2012

(54) AUXILIARY SUB-COOLER FOR REFRIGERATED DISPENSER

(75) Inventor: Nikolay Popov, Warrenville, IL (US)

(73) Assignee: IMI Cornelius Inc., Glendale Heights, IL (US)

( * ) Notice: Subject to any disclaimer, the term of this patent is extended or adjusted under 35 U.S.C. 154(b) by 774 days.

(21) Appl. No.: 12/291,965

(22) Filed: Nov. 14, 2008

(65) Prior Publication Data

US 2009/0165495 A1 Jul. 2, 2009

Related U.S. Application Data

(60) Provisional application No. 61/003,279, filed on Nov. 15, 2007.

(51) Int. Cl.
*F25D 3/00* (2006.01)

(52) U.S. Cl. ..... 62/389; 62/390

(58) Field of Classification Search ..... 62/389, 62/390, 344, 441; 222/631, 640
See application file for complete search history.

(56) References Cited

U.S. PATENT DOCUMENTS

| | | | | |
|---|---|---|---|---|
| 2,135,091 | A | 11/1938 | Newill | |
| 2,420,240 | A | 5/1947 | Haggerty | |
| 2,537,314 | A | 1/1951 | Mortensen | |
| 3,157,306 | A | 11/1964 | Courson | |
| 3,633,378 | A * | 1/1972 | Toth | 62/196.4 |
| 3,835,660 | A | 9/1974 | Franck | |
| 3,984,223 | A | 10/1976 | Whistler, Jr. | |
| 4,142,381 | A | 3/1979 | Lavigne, Jr. | |
| 4,171,622 | A * | 10/1979 | Yamaguchi et al. | 62/160 |
| 4,285,205 | A * | 8/1981 | Martin et al. | 62/113 |
| 4,474,017 | A | 10/1984 | Prada | |
| 4,475,354 | A | 10/1984 | Akerheilm et al. | |
| 4,483,156 | A | 11/1984 | Oudenhoven | |
| 4,586,348 | A | 5/1986 | Nakayama et al. | |
| 4,683,726 | A * | 8/1987 | Barron | 62/503 |
| 4,696,168 | A | 9/1987 | Woods et al. | |
| 4,811,568 | A * | 3/1989 | Horan et al. | 62/200 |
| 4,884,415 | A | 12/1989 | Mandel et al. | |
| 5,241,831 | A * | 9/1993 | Rockenfeller et al. | 62/102 |
| 5,255,531 | A | 10/1993 | Williams et al. | |
| 5,291,753 | A * | 3/1994 | Rockenfeller et al. | 62/480 |
| 5,379,833 | A | 1/1995 | Mathews | |
| 5,515,694 | A | 5/1996 | Meloling et al. | |
| 5,619,865 | A | 4/1997 | Maxwell | |
| 5,622,057 | A * | 4/1997 | Bussjager et al. | 62/173 |
| 5,638,694 | A | 6/1997 | Banicevic | |
| 5,660,050 | A | 8/1997 | Wilson et al. | |
| 5,865,038 | A | 2/1999 | Maxwell | |
| 6,196,007 | B1 * | 3/2001 | Schlosser et al. | 62/73 |
| 6,253,562 | B1 | 7/2001 | Bujak, Jr. | |
| 2002/0078705 | A1 * | 6/2002 | Schlosser et al. | 62/352 |
| 2003/0101735 | A1 * | 6/2003 | Teague et al. | 62/70 |
| 2004/0221608 | A1 * | 11/2004 | Jablonski | 62/344 |

* cited by examiner

*Primary Examiner* — Mohammad Ali
(74) *Attorney, Agent, or Firm* — Pyle & Piontek, LLC

(57) ABSTRACT

A freeze type dispenser having a refrigeration system including a compressor, condenser, expansion means and evaporator in the form of one or more freeze chambers in an enclosure is provided with a sub-cooler or auxiliary coil. The sub-cooler is located downstream of the condenser but upstream of the expansion means and is supplied with condensed refrigerant liquid. The sub-cooler is located adjacent the freeze chamber enclosure to prevent or reduce condensation of the same, without adversely affecting, and in fact increasing cooling performance or capacity.

45 Claims, 11 Drawing Sheets

| | 2 FREEZE CHAMBERS UNIT | | 3 FREEZE CHAMBERS UNIT | | 4 FREEZE CHAMBERS UNIT | |
|---|---|---|---|---|---|---|
| | LOW | HIGH | LOW | HIGH | LOW | HIGH |
| COMPRESSOR CAPACITY, BTU/hr | 11500 | 16700 | 14000 | 19100 | 14000 | 19100 |
| REFRIGERANT MASS FLOW, lbm/hr | 300 | 320 | 320 | 350 | 320 | 350 |
| SUB COOLER COIL LENGTH, INCHES | 60 | 100 | 85 | 125 | 110 | 150 |
| SUB-COOLER HEAT REJECTION, BTU/hr | 600 | 640 | 640 | 700 | 960 | 1050 |
| CONDENSER HEAT REJECTION, BTU/hr | 23800 | 25200 | 25700 | 27100 | 25700 | 27100 |
| HEAT REJECTION RATIO (BETWEEN CONDENSER AND SUB-COOLER), P3RCENT | 2.5 | | 2.6 | | 3.8 | |
| BOTTOM OF ENCLOSURE TEMPERATURE, DEG F AT 75 DEG F AMBIENT AIR | 82 | 91 | 82 | 91 | 84 | 93 |
| BOTTOM OF ENCLOSURE TEMPERATURE, DEG F AT 90 DEG F AMBIENT AIR | 97 | 106 | 97 | 106 | 99 | 108 |
| BOTTOM OF ENCLOSURE TEMPERATURE, DEF F AT 105 DEG F AMBIENT AIR | 112 | 121 | 112 | 121 | 114 | 123 |

FIG. 10

3 CHAMBER DISPENSER

4 CHAMBER DISPENSER

AUXILIARY SUB-COOLER FOR REFRIGERATED DISPENSER

This is a United States Non-Provisional, Continuation-in-Part patent application claiming the benefit of and the priority of U.S. Provisional patent application No. 61/003,279, filed Nov. 15, 2007, and relates to a refrigerated ice or beverage dispenser, and more particularly to an auxiliary sub-cooler in the refrigerant line after the condenser but before the refrigerant expansion means, provided with condensed liquid refrigerant used to heat the enclosure for a frozen beverage freeze chamber to reduce or eliminate condensation on the enclosure while also increasing freeze chamber cooling capacity.

BACKGROUND OF THE INVENTION

Heretofore, it is known, in for example, a beverage or ice unit or dispenser to have a freeze portion or chamber provided with compressed refrigerant which is discharged from a compressor, then sent through a condenser, and an expansion valve to provide cold refrigerant to form ice or semi-frozen beverage in the freeze portions or chambers. For packaging reasons and/or ease of replacement, the freeze portion or chamber is part of a "foam pack." That is, one or more freeze portions or chambers is encircled or surrounded by refrigerant lines, encased in foam insulation, and generally further enclosing the freeze chamber and its refrigeration lines and surrounding foam in a protective metal box or casing. The latter protective casing is generally formed of non-rusting material, such as aluminum or stainless steel. While such foam pack freeze chambers are successful, they have had the disadvantage of causing moisture and humidity to collect on the cold foam pack, and particularly its protective outer metal surface. Thus, humidity due to the low temperature may collect into droplets which can fall from the foam pack upon other components, such as electrical components, causing damage to such components, and can require additional maintenance. The condensate can also cause corrosion and loss of electrical continuity, shorting, component damage and water collecting on the floor. Typically, attempts to manage condensate have required a drip pan, a drain line and additional maintenance of the same.

A rule of thumb in the refrigeration is that the condenser is responsible for removing the heat off the hot gas refrigerant (coming from the compressor), while the liquid leaving the condenser can be sub-cooled further either in a liquid to suction heat exchanger or through external means. While it is known to use the hot gas from the compressor, as for example, in residential refrigerators to keep the surfaces around the freezer door warm and prevent freezing of the magnetic seals, usually this is just a small diverted refrigerant flow and that the capacity/mass flow of this refrigeration door system is typically small, hence needs to use the highest enthalpy media (hot gas).

While using hot gas from the compressor and before the condenser has the advantage that the gas is in its highest energy state (highest enthalpy) and temperature, it also has disadvantages. If, for example, such hot gas was used in the dispenser foam pack as there is limited surface area (in the foam pack to dissipate heat) for the full capacity/mass flow of the refrigeration system, in such instance, too much heat would be passed through the foam pack. Therefore, some of the excess heat would heat the evaporator coils and reduce performance, and is absolutely not desired.

SUMMARY OF THE PRESENT INVENTION

The present invention provides an apparatus and method for solving the above difficulties, while further increasing the refrigeration efficiency and cooling capacity of the unit or dispenser, be it ice, beverage, frozen carbonated beverage (FCB), or frozen uncarbonated beverage (FUB) dispensers. Instead of hot gas, in the present invention, warm liquid refrigerant after the condenser is used. This has the advantage of lower energy state (lower enthalpy and temperature). Almost all of the heat will be dissipated to keep the foam pack bottom warm to prevent condensation. Thus, the heat will not reach the evaporator coils, but instead, will also further cool the liquid refrigerant before its expansion to increase cooling capacity. The present invention comprises a freeze chamber (including its surrounding refrigeration lines), enclosed in insulation, surrounded by a protective metal casing and supplied with compressed liquid refrigerant, from a compressor and after the condenser, but before the evaporator, and more particularly through an auxiliary coil or sub-cooler located after the compressor and condenser but before an expansion means or valve supplying refrigerant to the sub-cooler. The sub-cooler is located or included in a portion of the condenser discharge line before the expansion means or valve and is preferably located in a lower portion of the foam pack to further cool the compressed or liquid refrigeration before its expansion and to also transfer heat from the liquid refrigerant to the protective enclosure, usually metal, of the foam pack to prevent or reduce condensation of humidity on the same. Thus, with the present invention, the advantages of eliminating or reducing condensation and associated problems and increased cooling capacity are achieved.

The method of the present invention comprises the steps of providing a dispenser with a compressor, condenser and freeze chamber surrounded by insulation and, usually a protective metal, enclosure, and an expansion means, comprising the steps of providing an auxiliary coil or sub-cooler adjacent the freeze chamber, supplying the sub-cooler with compressed liquid refrigeration from the condenser, locating said sub-cooler upstream of said expansion means, using the heat from liquid refrigerant in the sub-cooler to reduce or prevent condensation on the foam pack and its protective casing, and using the heat give up to the freeze chamber to lower the temperature of the liquid refrigerant provided to the expansion means, and then subsequently to the freeze chamber. The heat given up in the sub-cooler from the compressed liquid refrigerant prior to its expansion reduces or eliminates condensation and lowers the temperature of the liquid refrigerant going into the expansion valve to cause increased cooling in the freeze chamber.

The primary function of the sub-cooler or auxiliary coil is to keep the bottom of the foam pack warm (its temperature above the dew point). As a desirable side effect, we also get a small amount of sub-cooling of the liquid refrigerant in the sub-cooler after it leaves the condenser.

OBJECTS OF THE PRESENT INVENTION

It is an object of the present invention to provide a method and apparatus for reducing condensation from the freeze chambers of an ice and/or beverage dispenser.

Yet another object of the present invention is to provide a method and apparatus for increasing the freeze chamber cooling capacity of the unit it is incorporated therein.

Still another object of the present invention is a method and apparatus that provides a sub-cooler coil between a condenser and expansion means located adjacent the freeze chamber.

These and other objects of the present invention will become apparent from the following written description and the accompanying figures of the drawing wherein in:

BRIEF DESCRIPTION OF THE DRAWINGS

FIG. 10 is a table of component specifications and operating parameters for various freeze chamber arrangements.

DESCRIPTION OF THE PREFERRED EMBODIMENT

Figure 1:
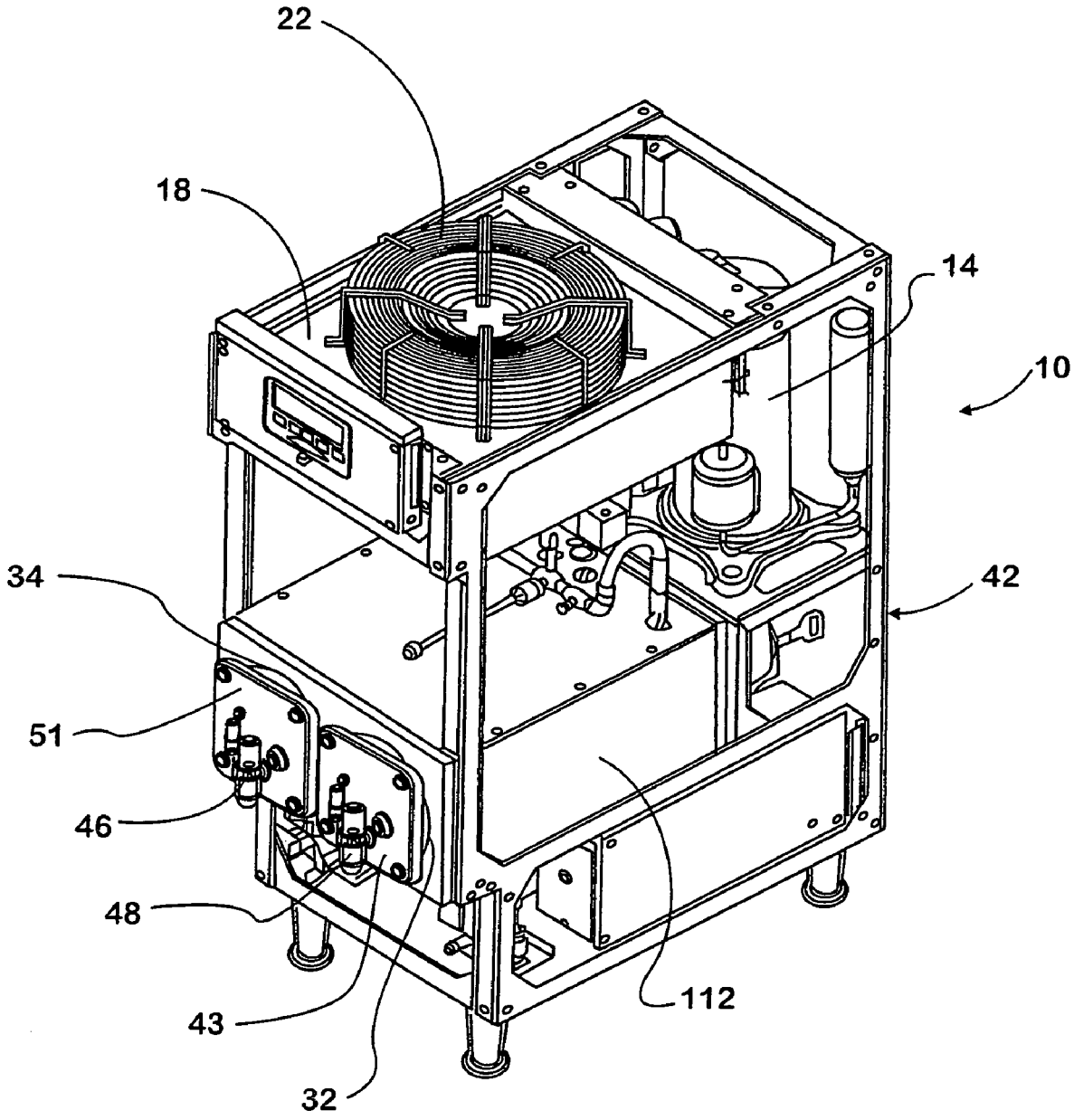
FIG. 1 is a perspective view of one form of dispenser in which the apparatus and method of the present invention may be utilized.

Referring to FIG. 1, a dispenser 10, in this instance a frozen carbonated beverage (FCB) dispenser, is shown. As is shown in FIG. 1 and also FIG. 2, the dispenser 10 herein includes refrigeration components, namely a compressor 14, a condenser 18, cooling fan 22 for the same, expansion means 26, an evaporator 28 in the form of two FCB freeze chambers 32 and 34. It should be understood that few (one) or three, four or more freeze chambers could be provided in the dispenser. See FIG. 10 table for sizing the various components for units with from two to four freeze chambers. While having multiple freeze chambers (or evaporators) there is usually only one compressor and condenser and auxiliary sub-cooler in each system. In this instance as more clearly shown in FIG. 2, there are separate expansion means in the form of expansion valves 36 and 38, one for each evaporator freeze chamber 32 and 34. It should be understood that other forms of expansion means could be used.

All these components are mounted to a frame 42 and provided with FCB output face plates 51 and 43 having FCB output valves 46 and 48. As is shown the compressor 14 is driven by a motor 48'. The compressor 14 is supplied by a refrigerant gas line 52, from an accumulator 54. The accumulator 54, in turn, is supplied with discharged cooled gas from the evaporator 28, and in this instance its two freeze chambers 32 and 34. It should be understood that there could be fewer or more freeze chambers.

From the compressor high pressure and temperature gas refrigerant is supplied by a line 60 to a pair of tees 62 and 64, which provides outputs to hot gas (say 120° F. to 160° F. or even and up to and including 240° F.) by pass valves 65 and 67 and the inlet for condenser 18. Refrigerant is cooled in the condenser and becomes a warm liquid (say about 95° F. to 125° F. or even and up to and including about 135° F.). From there this refrigerant is sent via line 66 to the auxiliary sub-cooler 68 of the present invention. The sub-cooler 68, as will be further made clear below, is located in the foam pack containing the evaporator 28 and its freeze chambers 32 and 34.

From the sub-cooler 68, the refrigerant flow is provided, via a tee 72, to two branches 74 and 76 to expansion means 26, in this instance separate expansion valves 36 and 38, preferably one for each of the freeze chamber 32 and 34. This construction provides for independent operation of each freeze chamber. That is each freeze chamber 32 or 34 can independently be provided with condensed refrigerant from its respective expansion valve 36 or 38 for cooling. Alternatively, hot compressed refrigerant gas from the compressor can be supplied via hot gas by pass valves 65 and 67 and their respective lines which connect to the respective freeze chambers 32 and 34, below or downstream of the respective then closed expansion valves 36 and 38 for defrosting or heating one or the other or both the freeze chambers. In the latter case this hot gas is not sent through the auxiliary sub-cooling coil 68.

From the freeze chamber 32 and 34, the cooled refrigerant gas (or heated gas) can be provided and flows through to the refrigerant lines 90 and 92 surrounding the freeze chambers 32 and 34.

In normal operation, the expanded and warmed gases are then collected and provided back to the accumulator 54 and then to the compressor 14 to be recycled and reused.

Figure 3:
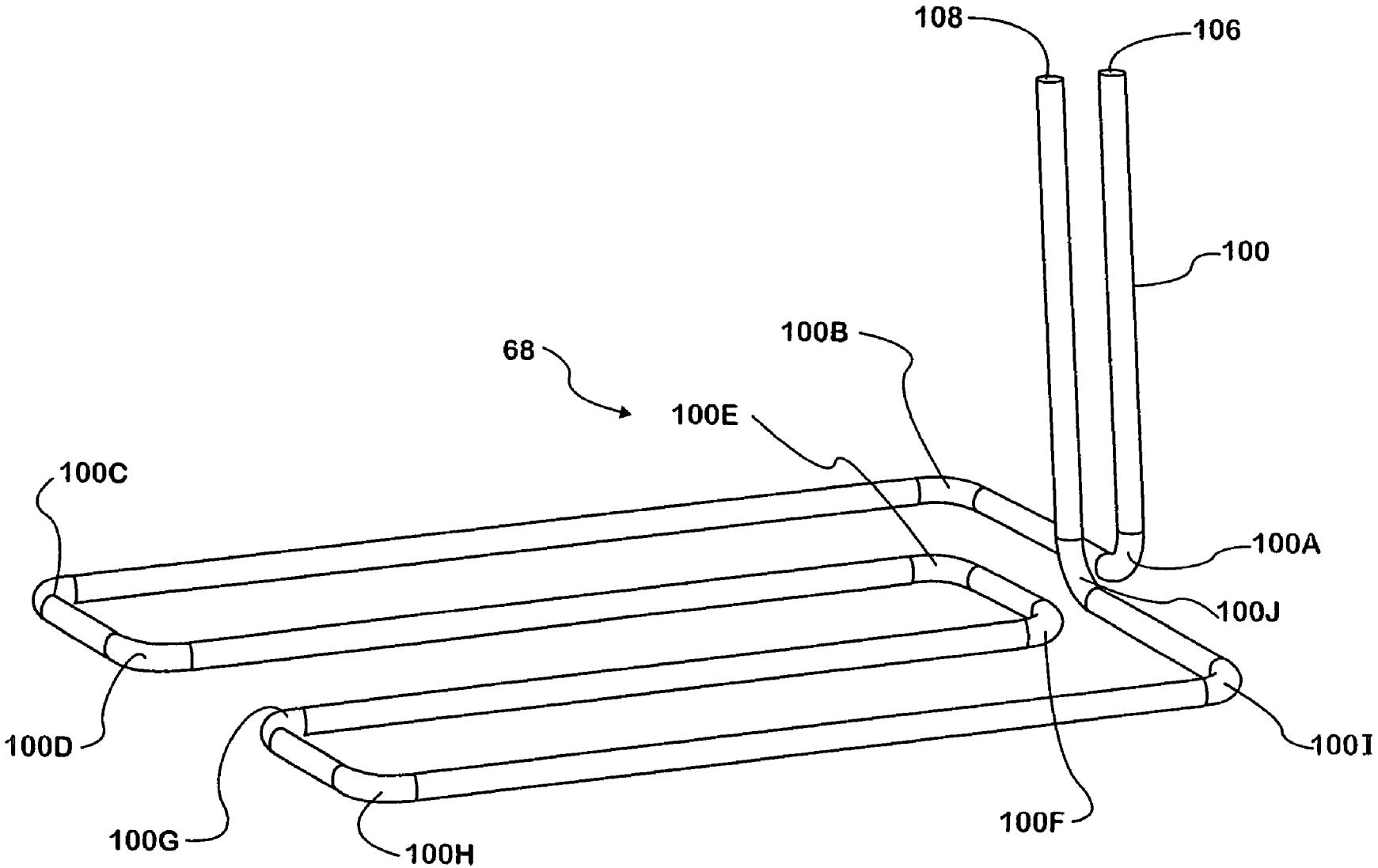
FIG. 3 is an enlarged perspective view of the sub-cooler or auxiliary coil or tubing of the present invention, prior to installation.

Referring to FIG. 3, the auxiliary coil or sub-cooler 68 of the present invention, in a preferred form is shown. As can be seen there is an input line or tube 100 connected in a serpentine path with ten right angle bends 100A to 100J to form a double pass for and beneath each of the freeze chambers.

Figure 2:
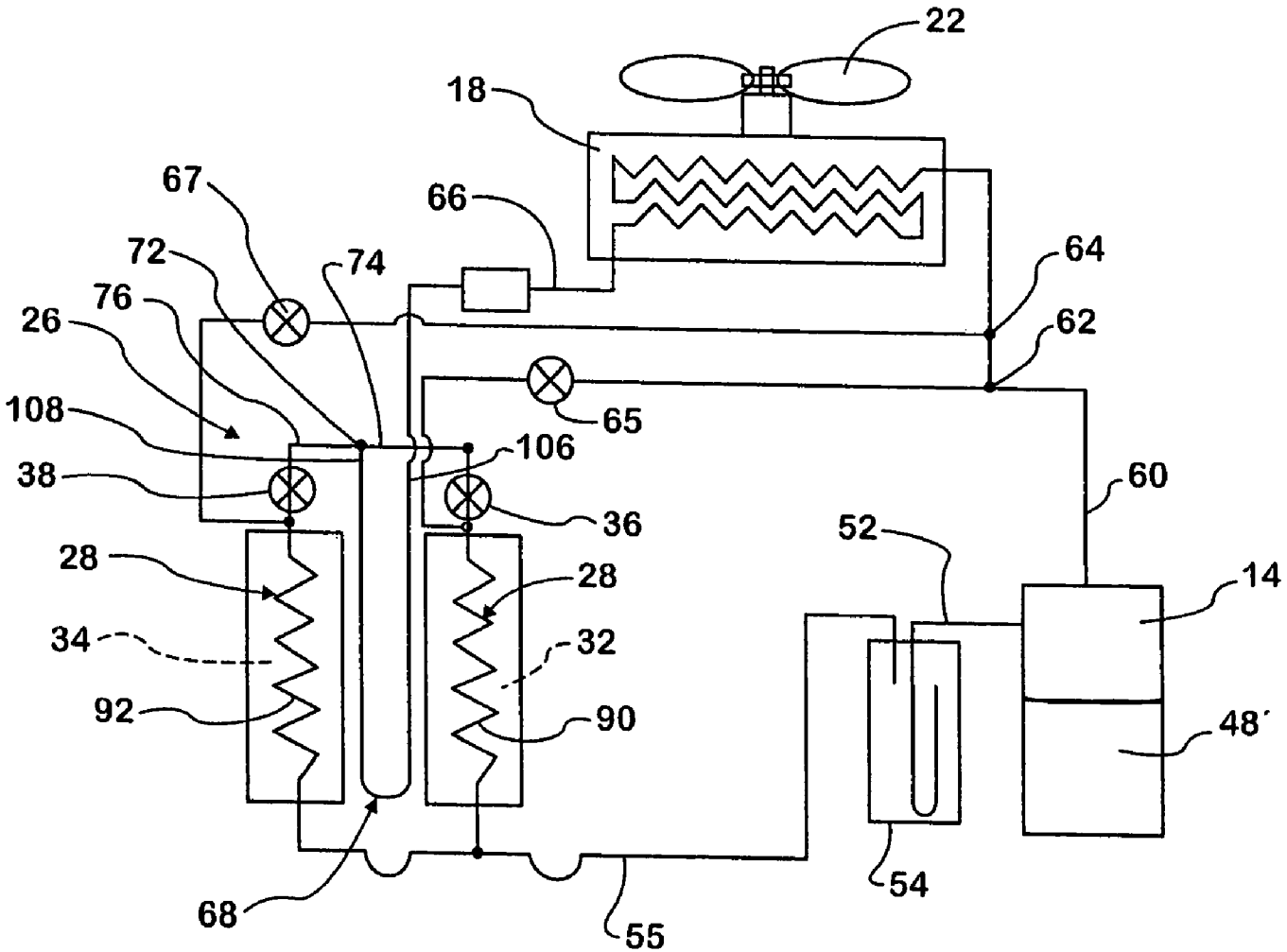
FIG. 2 is a schematic of a typical refrigeration system which can be utilized with the apparatus and method of the present invention.
Figure 4:
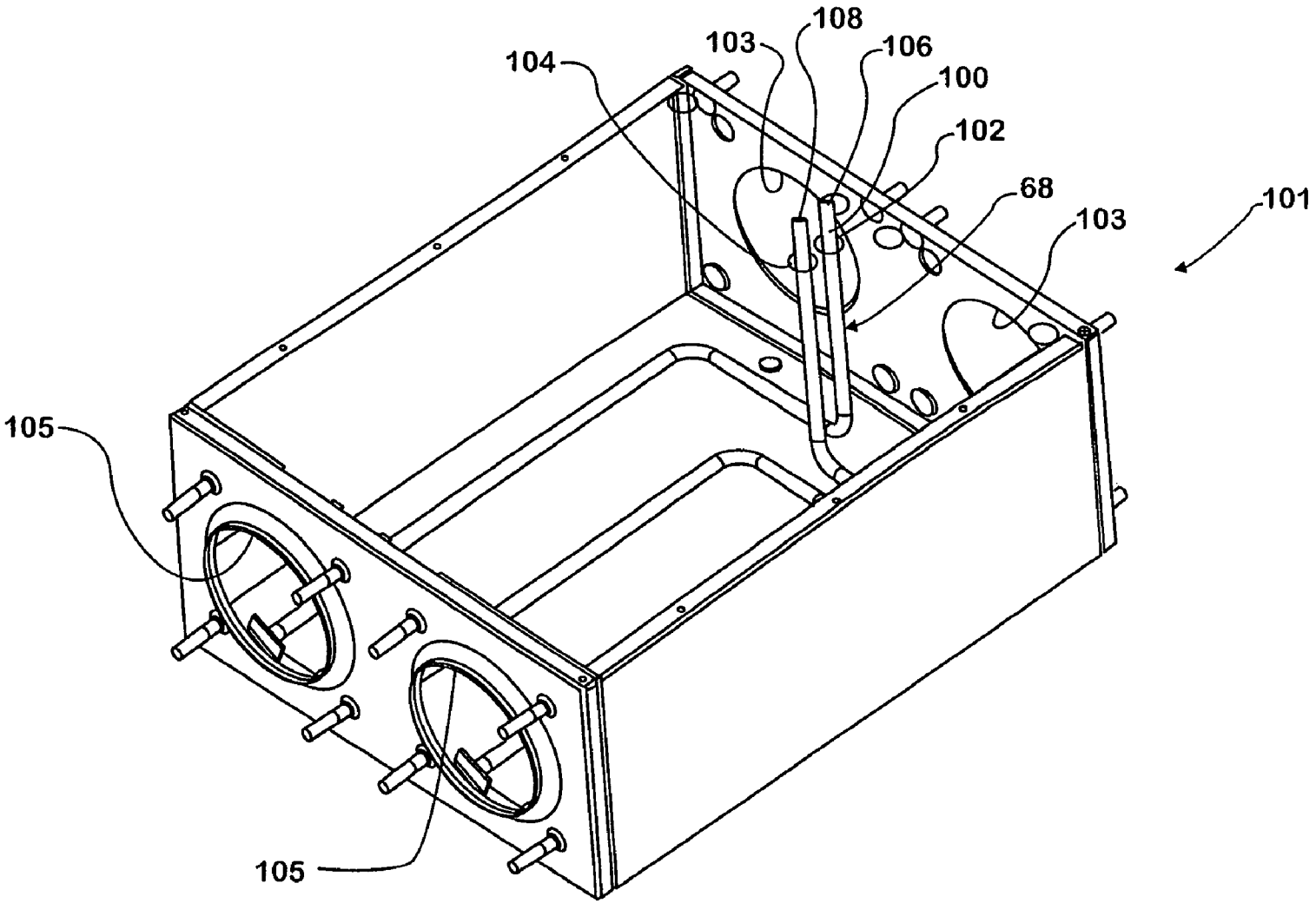
FIG. 4 is a perspective view of the foam pack protective case shown in FIG. 1 with the sub-cooler or coil of FIG. 3 of the present invention installed therein.

Referring to FIG. 4, the sub-cooling coil 68 is shown installed in the protective enclosure, casing or box 101 made of stainless steel or aluminum. The enclosure box has two opposed pairs of openings 103 and 105 for locating of the freeze chambers 32 and 34. The enclosure box also has a pair of openings 102 and 104 for input and output of the sub-cooler coil 68. As can be understood the input and output lines 106 and 108 will be connected to the appropriate portion of the refrigerant system as shown in FIG. 2.

Figure 5:
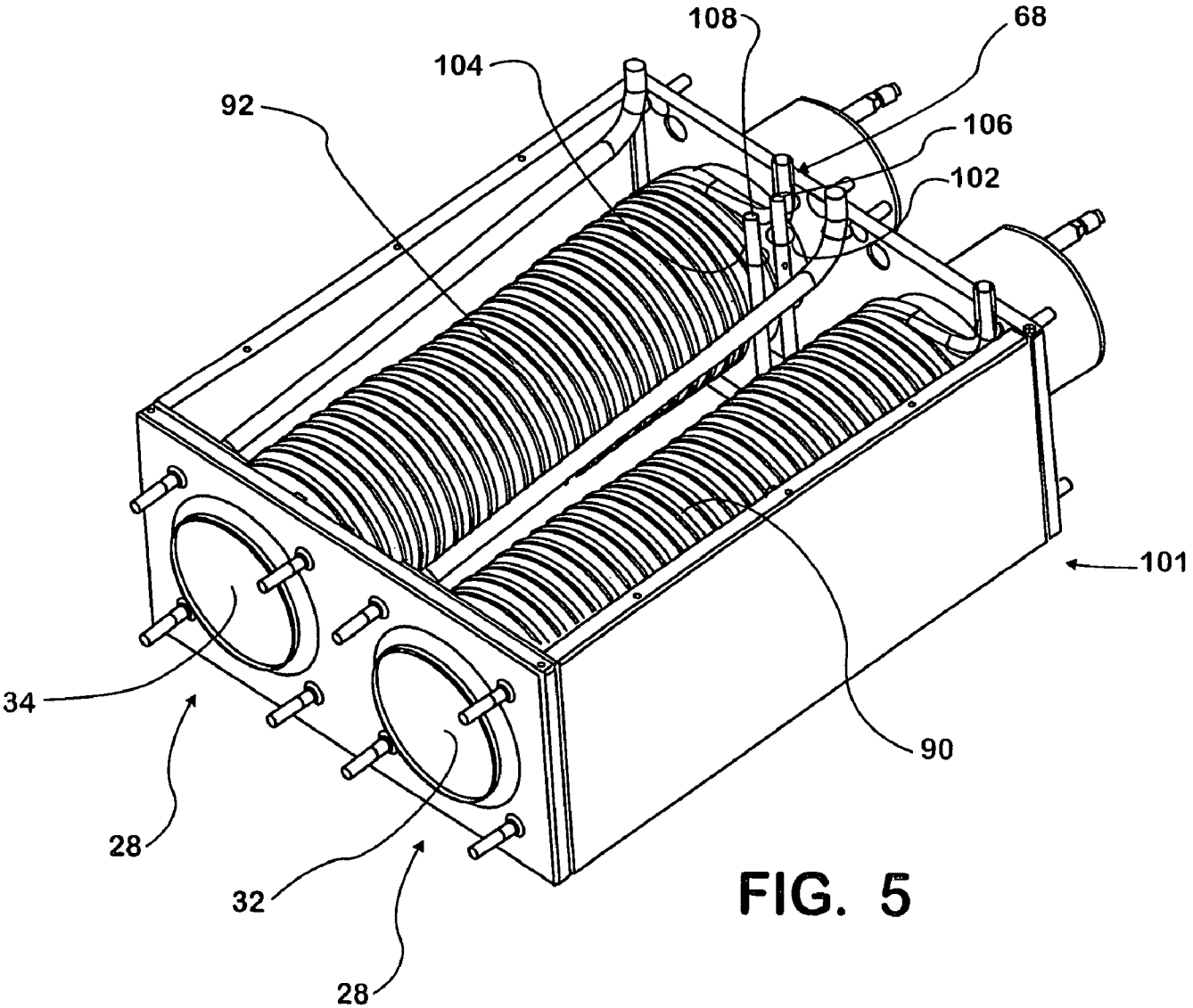
FIG. 5 is a top perspective view of the foam pack case in FIG. 4, with the freeze chambers and refrigeration lines installed therein with the sub-cooler of the present invention, prior to foaming in the insulation.
Figure 6:
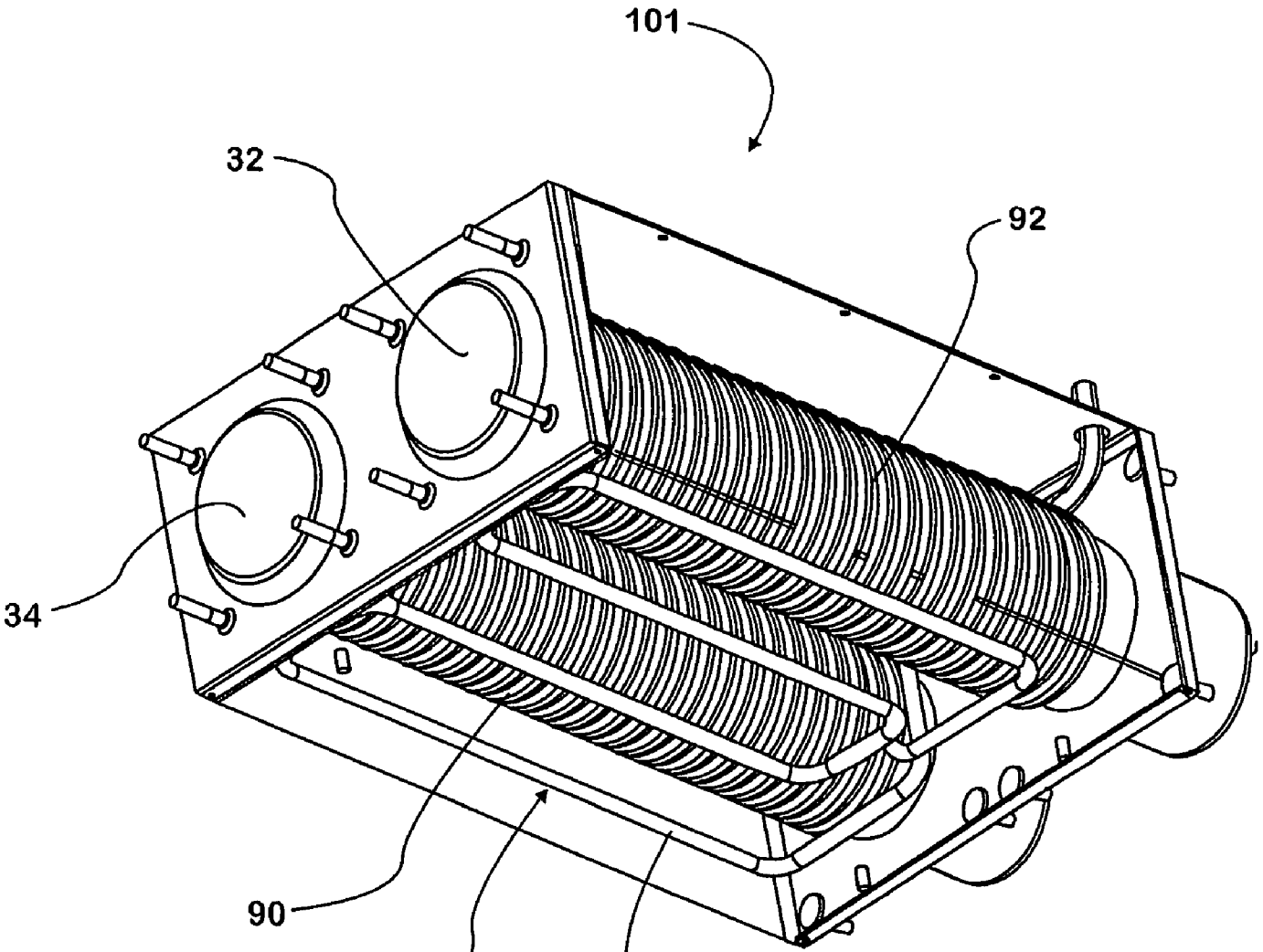
FIG. 6 is a view similar to FIG. 5, but showing the bottom thereof.
Figure 7:
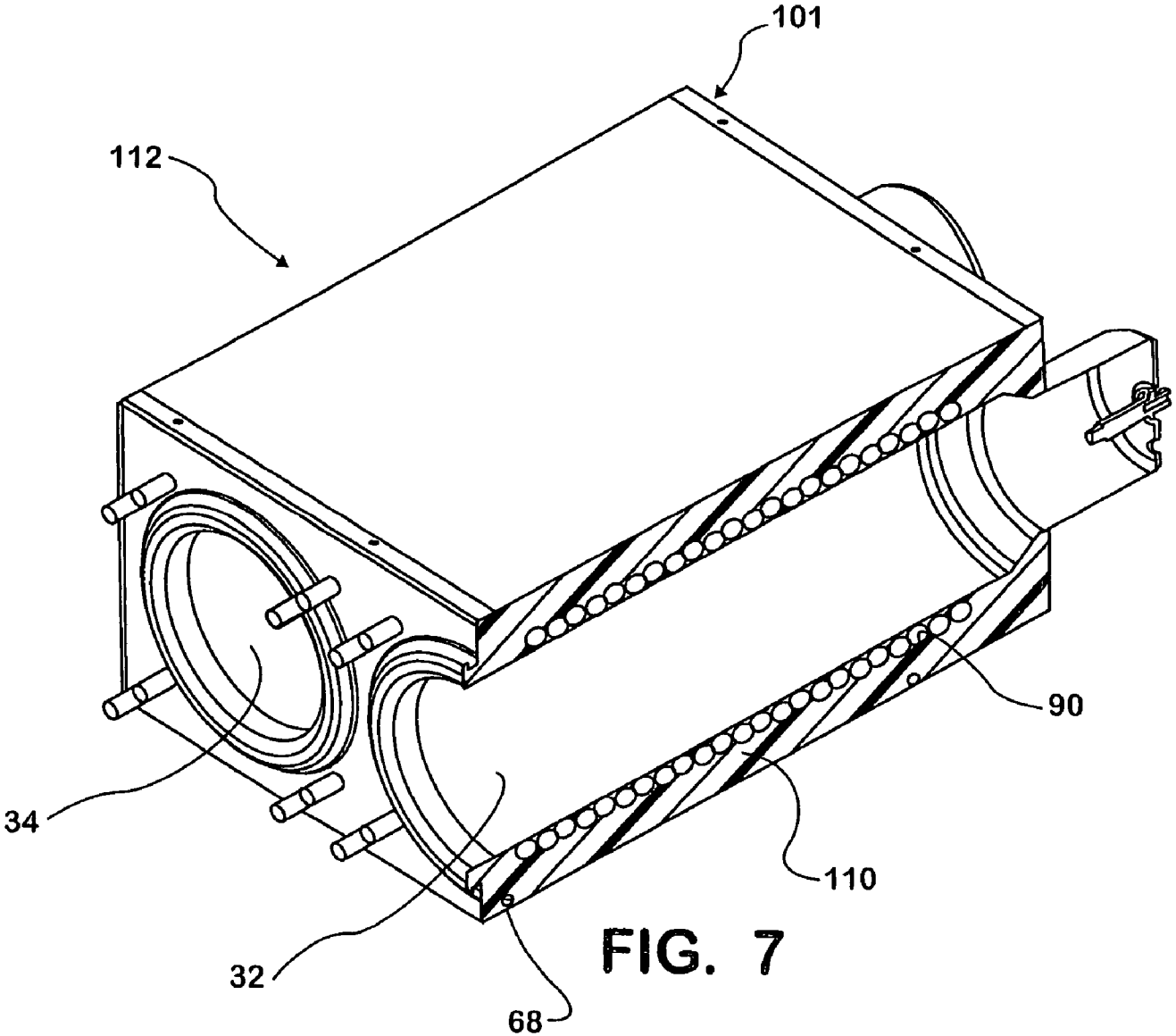
FIG. 7 is a partial, cross sectional, perspective view of the device of FIG. 5, but showing the insulation foamed in place.

Referring to FIGS. 5 and 6, the freeze chambers, with the auxiliary sub-coil 68 installed therein is shown, with FIG. 5 showing the top, and FIG. 6 showing the bottom, all before the foam put in place insulation is installed. The foam 110 of the foam pack 112 is shown in FIG. 7. This foam pack 112 would then be installed into the dispenser, shown in FIG. 1. It should be understood that the sub-cooler 68 is kept at least an inch or more, say two inches, from the refrigerant lines 90 and 92 forming the evaporator to eliminate and/or reduce heat transfer to the same.

With the dispenser described, the refrigeration system could use R404A refrigerant for maximum capacity and efficiency.

The dispenser would have typical compressor cooling capacity of about 14200 Btu/hr, but could range from about 11500 to 16700 Btu/hr or even up to and including about 19100 Btu/hr. See FIG. 10 table for various component capacities and operating parameters for units with from two to four freeze chambers.

Typical refrigerant mass flow through the system (including through the sub-cooler coil) is about 310 lbm/hr, but could range from about 300 to 320 lbm/hr or even up to and including about 350 lbm/hr.

Typical heat rejection from the condenser coil is about 24400 Btu/hr, but could range from about 23800 to 25200 Btu/hr. or even up to and including about 27100 Btu/hr.

The sub-cooler coil diameter is ⅜ inch, (but ¼ to ½ inch could be used) and coil length mainly in contact with the sheet metal bottom is about 80 inches, but could be say from about 60 to 100 inches or even up to and including about 150 inches.

Typical heat rejection from sub-cooler coil is about 620 Btu/hr, but could range from about 600 to 640 Btu/hr or even up to and including about 1200 Btu/hr.

The ratio between sub-cooler heat rejection and condenser coil heat rejection, "heat rejection ratio" is about 2.5% (but could be up to and including about 4%) throughout the operating range of the dispenser. For example: (1−((24400−620)/24400))*100=2.5%. One would want to appropriately size the sub-cooler coil for if it is too big requires more tubing, is difficult to package, also requires larger refrigeration charge, therefore the cost is higher, and if its too small the heat to keep the foam pack bottom warm may be insufficient, therefore failing to eliminate/reduce condensation under all operating conditions.

Figure 8:
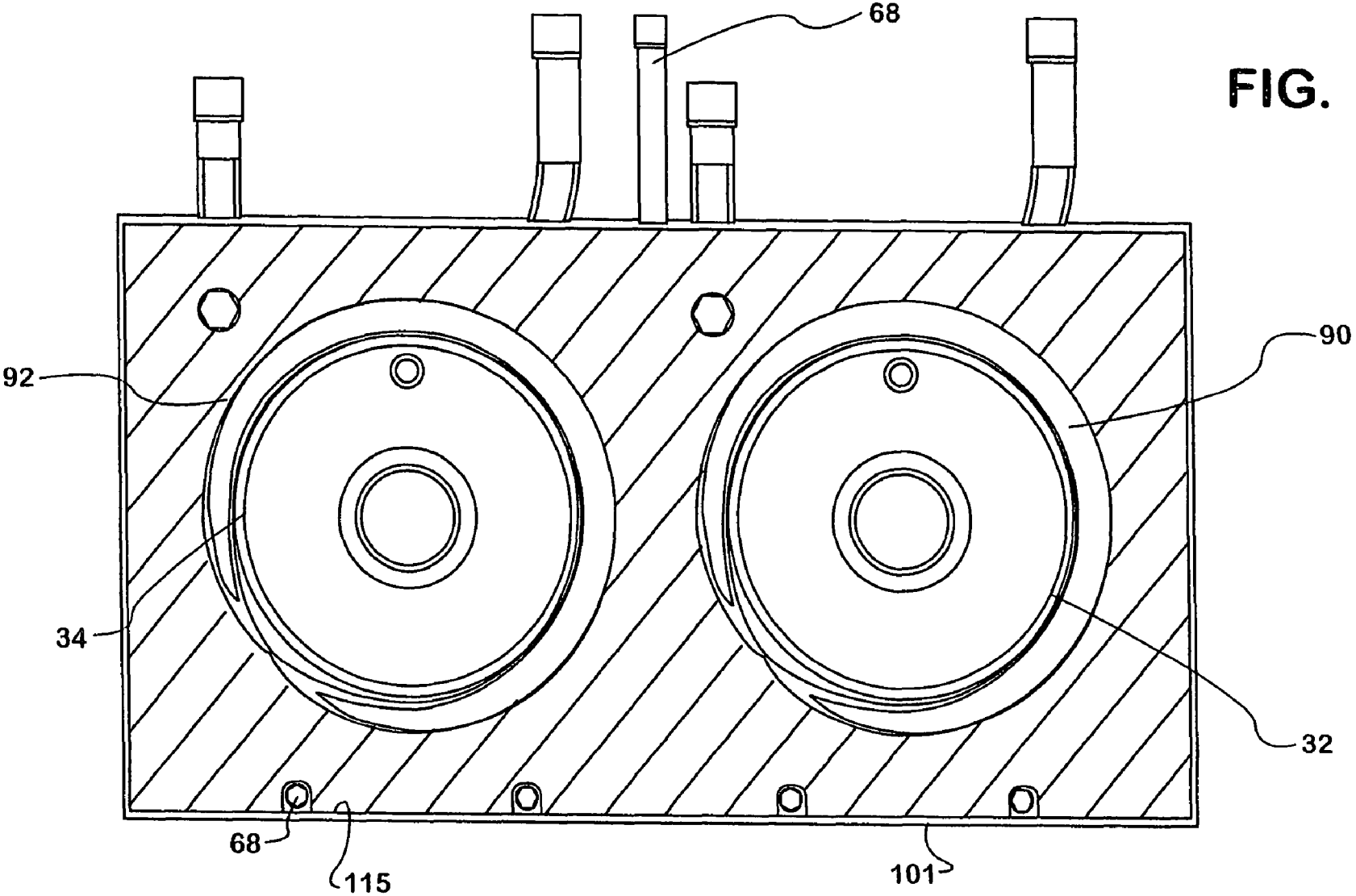
FIG. 8 is an enlarged cross sectional, perspective view of the device of FIG. 5, but showing the insulation foamed in place and the sub-cooler coil attached to the bottom of the enclosure box with an aluminum foil tape.

The frozen beverage dispenser sub-cooler is optimized to provide an even temperature distribution to and/or on the bottom surface of the foam pack 112 (FIG. 7). As noted, the sub-cooler is made preferably of a tubing diameter of about ⅜", but could be as small as about ¼ inch, say on a two freeze chamber unit, and as large as ½ inch on a four freeze chamber unit. The tubing is attached to the sheet metal of the enclosure using, say, an aluminum foil tape with adhesive 115 (see FIG. 8 of the cross section of the foam pack). It should be understood the tubing could be attached using an aluminum foil sheet. Consequently, injecting the insulation foam when it permanently sets also sets the aluminum foil tape and holds the sub-cooler or coil 68 closely in good heat transfer arrangement to the sheet metal bottom 113 of the enclosure. The foil tape acts as a "heat dissipater" to transfer heat on both sides of the sub-cooler tubing to the sheet metal 2 inches away.

Figure 9:
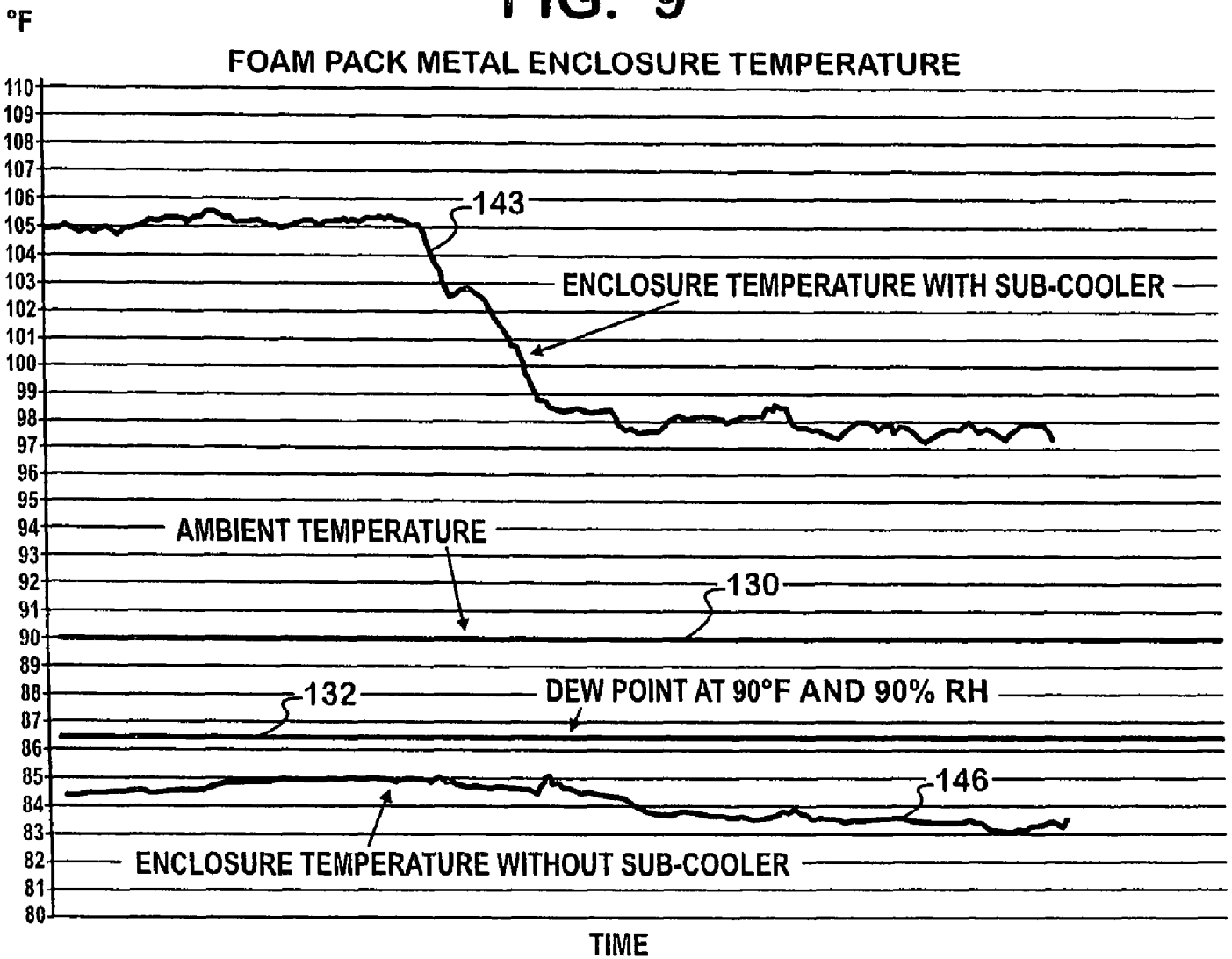
FIG. 9 is a comparison plot of a foam pack metal enclosure temperatures with and without the sub-cooler of the present invention.
Figure 11:
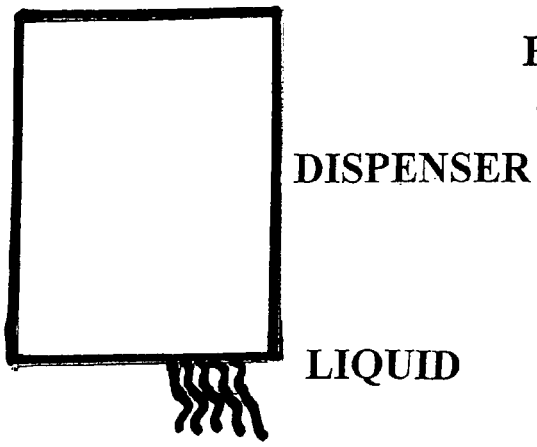
FIG. 11 is a schematic of a dispenser for dispensing a liquid beverage.
Figure 13:
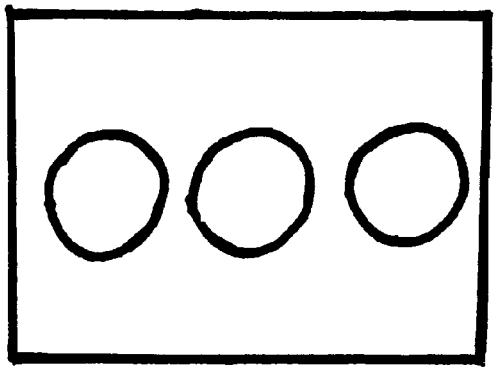
FIG. 13 is a schematic of a dispenser having three freeze chambers.
Figure 14:
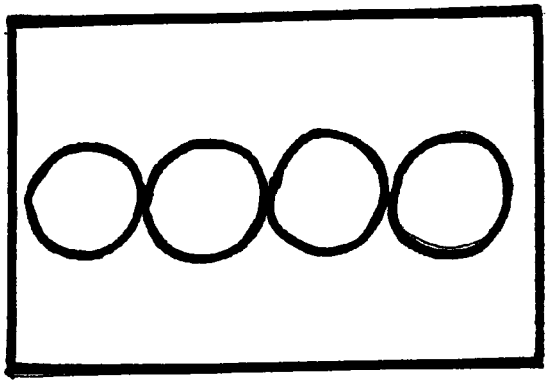
FIG. 14 is a schematic of a dispenser having four freeze chambers.
Figure 12:
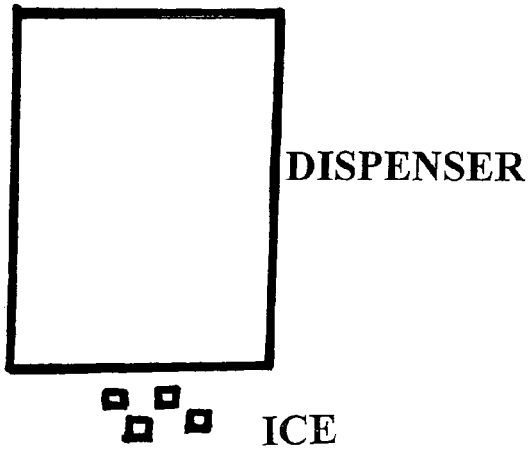
FIG. 12 is a schematic of a dispenser dispensing ice, or ice only

FIG. 9 shows the comparison of nearly identical dispensers (one with and the other without the present invention) in the same environment, and that the present invention would prevent condensate forming on the metal outer shell of the foam pack. At 90° F. ambient temperature (line 130), the sub-cooler provides an additional two degrees Fahrenheit of liquid refrigerant sub-cooling. The two additional degrees of sub-cooling increase the refrigeration capacity by approximately 2%. The dissipated heat warms the sheet metal bottom 113 from 97° F. to 106° F. (or even up to about 125° F.) (line 143) depending on the refrigeration "ON" time. If no subcooler is embedded in the foam pack, the sheet metal surface temperature would be from 85° F. to 83° F. (line 146). Of course it should be understood that this bottom temperature could warm as the ambient, environment or surroundings warm from 75, 90 or 105° F., shown in the table in FIG. 10.

If the dispenser is operating in a tropical environment the ambient temperature could be 90° F. (line 130) and the relative humidity is 90% and the dew point for this condition is 86.5° F. (line 132). In this case the foam pack with the sub-cooler coil of the present invention will not form condensation, because the bottom of the foam pack is warmer (97° F. to 106° F.) than the ambient 90° F. temperature (line 130) therefore it will always be warmer than the dew point temperature (line 132). However, the form pack without the sub-cooler would form water condensation and would sweat because the surface temperature (85° F. to 83° F.) (line 146) would be lower than the dew point (86.5° F.) (line 132).

As noted the supply of compressed condensed liquid to the foam pack 112 can prevent formulation of condensation on the exterior of the foam pack, while the additional cooling provided to the refrigerant liquid enhances the cooling in the freeze chamber.

While the present invention shows the sub-cool internally, there are other ways to accomplish the invention objectives, such as using a coil attached to the outside sheet metal surface of the foam pack. The present invention reveals an economical, energy efficient well designed and manufacturable method.

While the preferred embodiment has been disclosed and illustrated, it should be understood that the equivalent elements and steps of those set forth in the following claims.

What we claim is:

1. A dispenser for dispensing a semi frozen product beverage, comprising a refrigeration system including a compressor for compressing refrigerant to a hot gas, condenser, expansion means and an evaporator, said evaporator being in the form of the freeze chamber for forming said semi frozen product beverage, said freeze chamber being contained in a freeze chamber enclosure, an auxiliary sub-cooler, located between the condenser and the expansion means for said freeze chamber, said auxiliary sub-cooler being provided with warm liquid from said condenser, said auxiliary sub-cooler being located below said freeze chamber and within said freeze chamber enclosure, said warm liquid in said auxiliary sub-cooler raising the temperature of said freeze chamber enclosure adjacent said auxiliary sub-cooler, said freeze chamber having a valve for dispensing the semi frozen product beverage therefrom, wherein condensation on the freeze chamber enclosure can be reduced or eliminated and additional cooling provided to the refrigerant before the expansion means.

2. A dispenser as in claim 1, wherein said auxiliary sub-cooler comprises tubing extending beneath said freeze chamber.

3. A dispenser as in claim 2, wherein said sub-cooler is serpentine in shape.

4. A dispenser as in claim 2, wherein said freeze chamber enclosure has a bottom and said auxiliary sub-cooler is located above the bottom of said freeze chamber enclosure.

5. A dispenser as in claim 1, wherein there are at least two of said freeze chambers, a foam pack being provided around said freeze chambers, said foam pack being within said freeze chamber enclosure, said auxiliary sub-cooler being in said foam pack.

6. A dispenser as in claim 5, wherein said auxiliary sub-cooler is tubular and enclosed in said foam pack.

7. A dispenser as in claim 1, wherein refrigerant is provided from said compressor in the form of a hot gas to said condenser, and from there in the form of a liquid refrigerant to said freeze chamber, at least a portion of said hot gas being divertable to said freeze chamber for defrosting the freeze chamber.

8. A dispenser as in claim 7, wherein said compressor supplies hot gas and selectively said hot gas can be supplied to said freeze chamber.

9. A dispenser as in claim 1, wherein said auxiliary sub-cooler is in series with said freeze chamber.

10. A dispenser as in claim 9, wherein said expansion means is down stream of said auxiliary sub-cooler.

11. A dispenser as in claim 1, wherein said compressor has a cooling capacity of from about 11500 to about 19000 BTU/Hr.

12. A dispenser as in claim 11, wherein said auxiliary sub-cooler has a refrigerant mass flow of about 300 to about 350 LBM/Hr.

13. A dispenser as in claim 11, wherein said sub-cooler is from about ¼ to about ½ inch in diameter tube, and of a length of from about 60 to about 150 inches.

14. A dispenser as in claim 11, wherein a ratio of sub-cooler heat rejection to condenser heat rejection is about 0.025 to 1.000 to about 0.040 to 1.000.

15. A dispenser as in claim 11, wherein said sub-cooler has a heat rejection of about 600 to about 1050 BTU/Hr.

16. A dispenser as in claim 1, wherein said hot gas is from about 120° F. to about 240° F.

17. A dispenser as in claim 1, wherein refrigerant from said condenser is from about 95° F. to about 135° F.

18. A dispenser as in claim 5, wherein said freeze chambers can be operated independently of each other.

19. A dispenser as in claim 1, wherein a bottom of said freeze chamber enclosure is kept at about 97° F. to about 108° F. at an ambient temperature of about 90° F.

20. A dispenser as in claim 1, wherein a bottom of said freeze chamber enclosure is kept above the ambient dew point temperature.

21. A dispenser as in claim 2, wherein said freeze chamber enclosure has a bottom and said auxiliary sub-cooler is above the bottom of said freeze chamber enclosure, there are at least two freeze chambers, a foam pack being provided around said freeze chambers and within said freeze chamber enclosure, said at least two freeze chambers, said foam pack and said auxiliary sub-cooler being within said freeze chamber enclosure, said auxiliary sub-cooler being enclosed in said foam pack, said auxiliary sub-cooler being in series with said freeze chamber, said expansion means being downstream of said auxiliary sub-cooler, said compressor having a cooling capacity of from about 11500 to about 19100 BTU/Hr, said sub-cooler being from about ¼ to about ½ inch in diameter tube and of a length of from about 60 to about 150 inches, said hot gas being from about 120° F. to about 240° F., refrigerant from said condenser being from about 95° F. to about 135° F., said freeze chambers can be operated independently of each other, and said bottom of said freeze chamber enclosure is kept above the ambient dew point temperature, whereby condensation on said bottom of said freeze chamber enclosure is prevented and additional cooling is provided to the refrigerant supplied to said expansion means.

22. A dispenser as in claim 21, wherein said sub-cooler is serpentine, said auxiliary sub-cooler having a refrigerant mass flow of about 300 to about 350 LBM/Hr, said sub-cooler heat rejection to condenser heat rejection being in a ratio of about 0.025 to 1.000, or to about 0.040 to 1.000, said sub-cooler has a heat rejection of about 600 to about 1200 BTU/Hr, and the bottom of said freeze chamber enclosure is kept at about 97° to 108° F. with a 90° F. ambient temperature.

23. A dispenser as in claim 1, comprising three freeze chambers.

24. A dispenser as in claim 1, comprising four freeze chambers.

25. A method for dispensing a semi frozen product beverage from a dispenser including a refrigeration system having a compressor for compressing refrigerant to a high pressure hot gas, a condenser, expansion means and an evaporator, said evaporator being in the form of a freeze chamber for forming said semi frozen product beverage and having a valve for dispensing the semi frozen product beverage therefrom, said freeze chamber being enclosed in a freeze chamber enclosure, comprising the steps of: providing an auxiliary sub-cooler, locating the auxiliary sub-cooler in the refrigerant system between the condenser and the expansion means for said freeze chamber, providing hot gas refrigerant from said compressor to said condenser, providing from said condenser warm liquid to said auxiliary sub-cooler, cooling said refrigerant in said auxiliary sub-cooler, heating and raising the temperature of the freeze chamber enclosure adjacent said auxiliary sub-cooler with the warm liquid, and preventing formation of condensation on the freeze chamber enclosure, whereby condensation forming and dripping from said freeze chamber enclosure can be reduced or eliminated and additional cooling provided to the refrigerant before the expansion means.

26. A method as in claim 25, comprising the step of forming said auxiliary sub-cooler with tubing and extending said tubing beneath said freeze chamber.

27. A method as in claim 26, comprising the step of shaping said tubing into a serpentine shape.

28. A method as in claim 26, wherein freeze chamber enclosure has a bottom, and comprising the step of locating said auxiliary sub-cooler above the bottom of said freeze chamber enclosure.

29. A method as in claim 25, comprising the steps of providing at least two freeze chambers, providing a foam pack around said freeze chambers, and locating said auxiliary sub-cooler in said foam pack.

30. A method as in claim 29, comprising the step of forming said auxiliary sub-cooler from tubing and enclosing said tubing in said foam pack.

31. A method as in claim 25, comprising the steps of providing refrigerant from said compressor in the form of a hot gas to said condenser, and from there providing in the form of a liquid refrigerant to said auxiliary sub-cooler and to said expansion means, providing expanded cooled gas to said freeze chamber, and selectively diverting at least a portion of said hot gas to said freeze chamber for defrosting the freeze chamber.

32. A method as in claim 25, comprising the step of providing said auxiliary sub-cooler in series with said freeze chamber.

33. A method as in claim 32, comprising the step of providing said auxiliary sub-cooler upstream of said expansion means.

34. A method as in claim 25, comprising the step of providing a cooling capacity of from about 11500 to about 19000 BTU/Hr for said compressor.

35. A method as in claim 34, comprising the step of providing a refrigerant mass flow of about 300 to about 350 LBM/Hr for said auxiliary sub-cooler.

36. A method as in claim 34, comprising the step of providing tubing from about ¼ to about ½ inch in diameter tube and of a length of from about 60 to about 150 inches for said sub-cooler.

37. A method as in claim 34, comprising the step of providing a ratio of sub-cooler heat rejection to condenser heat rejection of about 2.5 to about 4.0%.

38. A method as in claim 25, comprising the step of providing a heat rejection of about 600 to about 1200 BTU/Hr for said sub-cooler.

39. A method as in claim 25, comprising the steps of heating and keeping a bottom of said freeze chamber enclosure at about 82° F. to about 125° F. with heat from said auxiliary sub-cooler.

40. A method as in claim 25, comprising the steps of heating and keeping a bottom of said freeze chamber enclosure above the ambient dew point temperature with heat from said auxiliary sub-cooler.

41. A method as in claim 25, wherein freeze chamber enclosure has a bottom, and comprising the steps of locating said auxiliary sub-cooler above the bottom of said freeze chamber enclosure, providing at least two freeze chambers, providing said auxiliary sub-cooler in series with said at least two freeze chambers, providing said auxiliary sub-cooler upstream of said expansion means, providing a foam pack around said freeze chambers, locating said auxiliary sub-cooler in said foam pack, locating said at least two freeze chambers in said foam pack and within said freeze chamber enclosure, keeping a bottom of said enclosure above the ambient dew point temperature with heat from said auxiliary sub-cooler.

42. A method as in claim 41, comprising the steps of forming said auxiliary sub-cooler from tubing and enclosing said tubing in said foam pack, shaping said tubing into a serpentine shape, providing a cooling capacity of from about 11500 to about 19100 BTU/Hr for said compressor, providing a heat rejection of about 600 to about 1200 BTU/Hr for said sub-cooler, providing a refrigerant mass flow of about 300 to about 350 LBM/Hr for said auxiliary sub-cooler, and heating and keeping a bottom of said freeze chamber enclosure at about 82° F. to about 125° F. with heat from said auxiliary sub-cooler.

43. A method as in claim 42, comprising the steps of providing tubing from about ¼ to about ½ inch in diameter tube and of a length of from about 60 to about 150 inches for said sub-cooler, and providing a ratio of sub-cooler heat rejection to condenser heat rejection of about 0.025 to 1.000 to about 0.040 to 1.000.

44. A method as in claim 41, comprising the steps of providing refrigerant from said compressor in the form of a hot gas to said condenser, and from there providing in the form of a warm liquid refrigerant to said auxiliary sub-cooler and to said expansion means, providing expanded cooled gas to said freeze chamber, and selectively diverting at least a portion of said hot gas to said freeze chamber for defrosting the freeze chamber, providing at least two freeze chambers, providing a foam pack around said freeze chambers, locating said auxiliary sub-cooler in said foam pack, and locating said at least two freeze chambers, said foam pack and said auxiliary sub-cooler within said freeze chamber enclosure.

45. A method for operating a frozen product beverage dispenser comprising: operating a compressor and compressing a refrigerant, transferring the refrigerant to a condenser and removing heat from the same, transferring the refrigerant to an auxiliary sub-cooler located in a foam pack, containing the frozen product beverage freeze chamber, in the foam pack, enclosing the foam pack and the frozen product beverage freeze chamber in an enclosure, transferring heat from the sub-cooler and from the refrigerant thereon to said enclosure, further cooling the refrigerant using the heat from the sub-cooler and refrigerant therein to heat said enclosure around said foam pack, frozen product freeze chamber and auxiliary sub-cooler therein, and preventing condensation forming on said enclosure, transferring the refrigerant onto expansion means, expanding the refrigerant, transferring the expanded refrigerant to the frozen product freeze chamber to cool and form the frozen product beverage in the freeze chamber, and returning the heated refrigerant to the compressor.

* * * * *